US005225269A

United States Patent [19]

Bohlin

[11] Patent Number: 5,225,269

[45] Date of Patent: Jul. 6, 1993

[54] PRESS FELT

[75] Inventor: Karl-Erik Bohlin, Norrköping, Sweden

[73] Assignee: Scandiafelt AB, Hogsjo, Sweden

[21] Appl. No.: 899,028

[22] Filed: Jun. 15, 1992

Related U.S. Application Data

[63] Continuation of Ser. No. 543,888, Jun. 27, 1990, abandoned.

[30] Foreign Application Priority Data

Jun. 28, 1989 [SE] Sweden ..... 8902337

[51] Int. Cl.[5] ..... B32B 5/02

[52] U.S. Cl. ..... 428/234; 139/383 AA; 162/900; 428/222; 428/223; 428/257; 428/280; 428/282; 428/300; 428/193

[58] Field of Search ..... 139/383 A, 383 AA; 162/358, DIG. 1; 428/222, 223, 234, 280, 282, 257, 193, 300

[56] References Cited

U.S. PATENT DOCUMENTS

| | | | |
|---|---|---|---|
| 4,283,454 | 8/1981 | Buchanan | 428/233 |
| 4,503,113 | 3/1985 | Smart | 428/234 |
| 4,533,594 | 8/1985 | Buchanan | 428/234 |
| 4,537,816 | 8/1985 | Booth et al. | 428/234 |
| 4,601,785 | 7/1986 | Lilja et al. | 162/199 |
| 4,698,250 | 10/1987 | Talonen et al. | 428/58 |
| 4,939,025 | 7/1990 | Nicholas | 428/234 |
| 5,023,132 | 6/1991 | Stanley et al. | 428/234 |

FOREIGN PATENT DOCUMENTS

| | | |
|---|---|---|
| 429982 | 10/1983 | Sweden . |
| 460293 | 9/1989 | Sweden . |

*Primary Examiner*—James J. Bell

*Attorney, Agent, or Firm*—Jacobson, Price, Holman & Stern

[57] ABSTRACT

A needled press felt for dewatering of cellulose pulp in a paper making machine consists of a multi layer base fabric having longitudinal and transversal threads. In order to improve the dewatering capability of the press felt and making it easy to assemble, the dewatering side of the press felt consists of layer of coarse yarn (3), which has a weight per unit of length, which is at least twice as great as the one of the remaining parallel yarns (1, 2) of the base fabric. Further a seam which can be opened is arranged transversally to the running direction of the felt in the paper making machine.

3 Claims, 1 Drawing Sheets

PRESS FELT

This is a continuation of application Ser. No. 07/543,888, filed Jun. 27, 1990 which was abandoned upon the filing hereof.

This invention concerns a needled press felt for dewatering of cellulose pulp in a paper making machine, which felt consists of a multi layer base fabric having longitudinal and transversal threads.

At pulp drying machines for cellulose the pulp is dewatered and formed into a web in a first step on a forming wire, in a second step in the press section and the final drying takes place in a hot flow of air in a fan dryer or on heated drums. In the case when the pulp is dried by air, a large contact surface between air and the web is desirable in order that the drying shall be carried out as effectively as possible. A press felt having a rough surface is preferably used in order to increase the specific surface of the pulp web, the rough surface giving the pulp web a markedly embossed surface. A rough surface of the pulp web has a negative effect on drum dryers, because the heat transmission from the surface of the drum to the web will be small because of a smaller contact surface.

In order that the press felt shall give the wanted effect, it must be formed by thick yarns on the side, which is turned to the pulp web so that this will be embossed. A problem is however that the thick filaments will make the felt heavy and stiff and it will be difficult to install the felt in the paper making machine and this in turn will limit the use of such a press felt.

The object of the invention is to solve this problem so that it will not be necessary to narrow the press felt in order to guide it through the small openings in the machine. The characterizing features of the invention will be found in the enclosed patent claims.

An embodiment of the invention will be described below with reference to the enclosed drawings.

FIGS. 1A and B are thereby a part of a cross section of a final press felt, whereby the running direction through the paper making machine is transverse to the plane of the drawing.

Figure 1A:
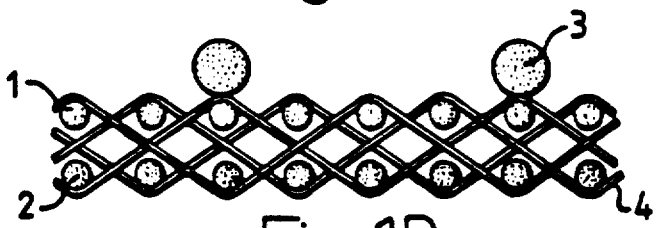
Figure 1B:
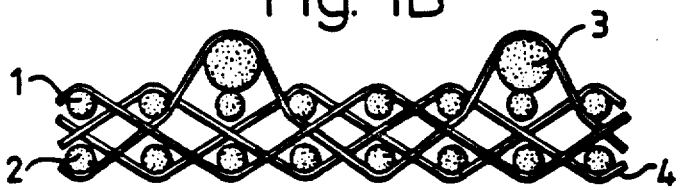

Thus FIG. 1A shows a fabric consisting of two layers of filaments 1 and 2, which form weft threads during weaving. A thicker yarn 3 is woven on that side of the fabric which forms the dewatering side. The yarns 3 have a weight per length, which is at least twice as large as the one of the yarns 1 and 2. The thicker yarn 3 forms an upper layer and this layer gives the wanted embossing to the cellulose pulp. In the shown embodiment FIG. 1B the binding of the yarns 3 is according to the pattern 4-shaft cross twill in two pattern repeats. As known per se, the weaving will form loops along one of the turning edges by the weft thread 1 and 2. The loops are formed around a selvedge end 6. The loops are used to form a seam which can be opened.

Figure 2:
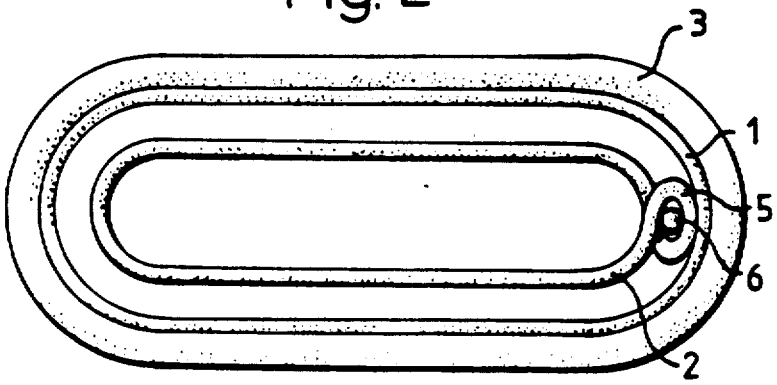
FIG. 2 is a schematic view of a cross section of the fabric in a weaving machine.

In FIG. 2 is schematically shown a cross section of a so called tubular fabric. The loops 5 have hereby been formed by the threads 1 and 2 around the selvedge end 6. The thicker yarns 3 are not formed with loops. Furthermore it should be emphazised that no binding with the warp yarns is shown in FIG. 2. When the fabric thus being a tubular fabric, shall be adapted to be a press felt, the yarns 3 are cut close to the loops and along a line which is parallel to the loops or to the selvedge end 6. When later the selvedge end is drawn out, the felt can be unfolded to its entire length. Before that the felt may be supplied with a layer of wad which is needled to the felt and gives it a better rigidity. A reinforced flap of wad is achieved over the area where the loops are, and thus over the seam which is possible to open, see Swedish patent 447 140. It is known per se from the Swedish patent 429 982 how to form such a seam.

Figure 3:
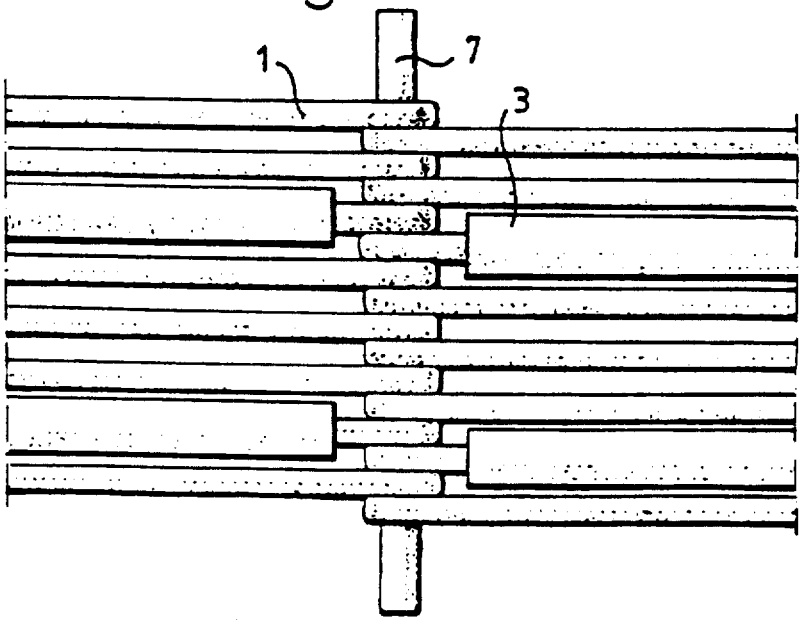
FIG. 3 is a schematic plan view over the stitch of the fabric with the locking wire assembled.

When the selvedge end is taken away the felt can be inserted with its entire length in the press of the pulp drying machine and when the felt has been inserted the both ends are joined by that the loops 5 meet and a locking wire 7 can be inserted through the loops. The press felt is hereby made tubular, see FIG. 3.

The yarns 1 and 2, which thus are the weft threads during the weaving but are longitudinal when being used in the paper making machine, are preferably monofilament from polyamide or polymer having similar properties and having a diameter of 0.3–0.7 mm corresponding to a tex No. of about 80–430. The yarn 3 is either monofilament or a twisted thin monofilament or multifilament having a weight per length, which is at least twice as great as for the yarns 1 and 2, thus at least 160 tex. Twisted thin monofilament or multifilament are preferably used. The warp yarn or the binding yarn 4 are suitably a simple monofilament or twisted thin monofilament.

I claim:

1. A needled press felt having a dewatering side and a non-dewatering side for dewatering of cellulose pulp in a drying machine comprising:

a woven multi layer base fabric having filament threads and binding threads;

a layer of coarse yarn threads, on said dewatering side, which are woven with said binding threads to said multi layer base fabric, the coarse yarn threads having a weight per unit length which is at least twice as great as that of the filament threads; the base fabric consists of a tubular fabric having turning edges and having a releasable seam extending substantially transversely to the direction of the movement of the press felt on the machine, said seam consisting of loops formed by the transverse threads along one of the turning edges and a fastening means;

the coarser yarns are cut such that they extend along a line substantially parallel with and close to said loops, said coarse yarn being no part of said seam.

2. The press felt of claim 1, wherein the rigidity of the felt is increased by means of a layer of wadding, said wadding consisting of fibers which are fastened to the upper side of the fabric by means of a needling process and wherein said fibers are cut transversely to the felt along the same line as the coarse yarn threads such that an endless fabric is formed which can be opened and seamed.

3. The press felt of claim 1, wherein the filament threads have a weight per length of unit of 80–430 tex and the coarse yarn threads have a weight per unit of length which is at least 160 tex.

* * * * *